US007308812B2

(12) United States Patent
Iida et al.

(10) Patent No.: US 7,308,812 B2
(45) Date of Patent: Dec. 18, 2007

(54) PROCESS FOR PRODUCING SEAMLESS STEEL PIPE

(75) Inventors: Sumio Iida, Takarazuka (JP); Tetsuya Nakanishi, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/639,227

(22) Filed: Dec. 15, 2006

(65) Prior Publication Data

US 2007/0157691 A1 Jul. 12, 2007

Related U.S. Application Data

(63) Continuation of application No. PCT/JP2005/010943, filed on Jun. 15, 2005.

(30) Foreign Application Priority Data

Jun. 18, 2004 (JP) ..... 2004-181484

(51) Int. Cl.
*B21B 45/02* (2006.01)

(52) U.S. Cl. ..... 72/42; 72/97; 72/236

(58) Field of Classification Search ..... 72/39, 72/41–45, 69, 96, 97, 236; 252/389.4, 389.41, 252/367.1

See application file for complete search history.

(56) References Cited

U.S. PATENT DOCUMENTS 3,577,754 A * 5/1971 Calmes ..... 72/45
5,859,124 A * 1/1999 Yorifuji et al. ..... 524/837
5,983,689 A * 11/1999 Yorifuji et al. ..... 72/42
6,202,463 B1 * 3/2001 Yorifuji et al. ..... 72/209
2007/0022796 A1 * 2/2007 Hayashi ..... 72/97

FOREIGN PATENT DOCUMENTS

| | | |
|---|---|---|
| JP | 50-144868 | 11/1975 |
| JP | 64-016894 | 1/1989 |
| JP | 7-084667 | 9/1995 |
| JP | 2000-042609 | 2/2000 |
| JP | 2000-246312 | 9/2000 |
| JP | 2004-223528 | 8/2004 |

* cited by examiner

*Primary Examiner*—Ed Tolan
(74) *Attorney, Agent, or Firm*—Clark & Brody

(57) ABSTRACT

A process for producing a seamless steel pipe, in which the occurrence of inner surface flaws in the pipe can be reduced through the lowering of the friction coefficient during the elongation rolling by means of a mandrel mill is provided. The reduction of inner surface flaws is accomplished through the use of a lubricant composed mainly of either or both of graphite and mica coated to the surface of a mandrel bar, and another lubricant composed mainly of an alkali metal borate that is applied onto the inner surface of the hollow stock pipe. The temperature of the pipe prior to receiving the lubricant, during lubricant application, and prior to elongation rolling is controlled. The time between descaling or piercing and lubricant application and between lubricant application and elongation rolling is also controlled.

1 Claim, 2 Drawing Sheets

PROCESS FOR PRODUCING SEAMLESS STEEL PIPE

This application is a continuation of International Patent Application No. PCT/JP2005/010943, filed Jun. 15, 2005. This PCT application was not in English as published under PCT Article 21(2).

TECHNICAL FIELD

The present invention relates to a process for producing a seamless steel pipe by elongation rolling of a hollow stock pipe, more specifically, a process in which the occurrence of inner surface flaws in the pipe that tend to occur during the elongation rolling can be reduced.

BACKGROUND ART

In manufacturing of a seamless steel pipe by the Mannesmann-mandrel mill process, a round billet heated in a rotary hearth furnace is pierced by a piercer to form a hollow shell, that is, a stock pipe. A mandrel bar with a lubricant applied to the surface is inserted into the shell in a skewering manner, and the shell is rolled into a predetermine dimension by a mandrel mill consisting of 5 to 9 stands at one pass. This is called elongation rolling.

After elongation rolling, the pipe is drawn out with the mandrel bar, cut off a portion with a poor pipe end shape with a hot saw, and reheated in a reheating furnace, and then the outer surface thereof is descaled with high-pressure water. The resulting pipe's outer diameter is successively reduced and the wall thickness is slightly reduced by a stretch reducer, and made into a predetermined product dimension. Thereafter, the pipe is cooled in a cooling bed, cut to a required length by a cold saw, and sent to a shaping line.

During the elongation rolling of the hollow stock pipe by the mandrel mill of the above-mentioned steps, a lubricant is generally applied to the surface of the mandrel mill. The reason for this is that relative slippage is caused between the inner surface of the hollow stock pipe and the surface of the mandrel bar during the elongation rolling, and the hollow stock pipe may stick to the mandrel bar if the interface between both is not sufficiently lubricated, and this may lead to the loss of a product with good inner surface quality. Therefore, the application of the lubricant to the surface of the mandrel bar is performed for preventing the sticking of the hollow stock pipe to the mandrel bar and also for ensuring a stable low friction coefficient.

A lubricant composed mainly of graphite is disclosed in Patent Literature 1, and a lubricant composed mainly of mica is disclosed in Patent Literature 2, these of which have been used.

Further, in recent years, for the purpose of improving the pipes inner surface quality, it has been proposed to apply a lubricant composed mainly of borax to the inner surface of the hollow stock pipe, thereby melting the scale on the inner surface is used, in order to improve the inner surface equality.

Patent Literature 1: Japan Patent Unexamined Publication No. S 50-144868

Patent Literature 2: Japan Patent Unexamined Publication No. S 64-16894

Patent Literature 3: Japan Patent Examined Publication No. H 7-84667

However, even if the lubricant composed mainly of borax is applied to the inner surface of the hollow stock pipe in mandrel mill rolling, the effect cannot be sufficiently exhibited in some cases. Further, the friction coefficient in rolling can be reversely increased, causing an undesirable phenomenon such as deterioration of inner surface quality.

DISCLOSURE OF THE INVENTION

Problem to be Solved by the Invention

It is an objective of the present invention to provide a process for producing a seamless steel pipe in manufacturing of a seamless steel pipe by Mannesmann-mandrel mill process, in which the occurrence of inner surface flaws in the pipe can be reduced by lowering the friction coefficient during the elongation rolling by means of a mandrel mill.

MEANS FOR SOLVING THE PROBLEMS

The present invention involves the following process for producing a seamless steel pipe.

A process for producing a seamless steel pipe excellent in inner surface quality, characterized by, comprising, during the elongation rolling of a hollow stock pipe by means of a mandrel mill, coating with a lubricant composed mainly of either or both of graphite and mica to the surface of a mandrel bar, and further applying a lubricant composed mainly of an alkali metal borate onto the inner surface of the hollow stock pipe, and also characterized by satisfying the following requirements (a) to (d):

(a) the temperature of inner surface of stock pipe immediately after the completion of piercing being set for not lower than 1150° C., and the time from the completion of piercing to the initiation of applying the lubricant composed mainly of an alkali metal borate, or the time from the completion of descaling to the initiation of applying lubricant composed mainly of an alkali metal borate is set for 5 to 60 seconds (hereinafter referred to as "Requirement (a)"), (b) the temperature of inner surface of stock pipe during applying the lubricant, composed mainly of an alkali metal borate, being set for not lower than 1100° C. (hereinafter referred to as "Requirement (b)"), (c) the time from the completion of applying the lubricant, composed mainly of an alkali metal borate to the initiation of elongation rolling, being set for not less than 10 seconds (hereinafter referred to as "Requirement (c)"), (d) the temperature of inner surface of stock pipe immediately before the elongation rolling, being set within a range from 1000 to 1170° C. (hereinafter referred to as "Requirement (d)").

The "lubricant composed mainly of either or both of the graphite and mica" means a lubricant containing not less than 50 mass % of graphite or mica alone in a dried film state, or a lubricant containing not less than 50 mass % in total of graphite and mica.

The "lubricant composed mainly of an alkali metal borate" means a lubricant containing not less than 50 mass % of an alkali metal borate. Furthermore, borax, which is composed mainly of $Na_2B_4O_7.10H_2O$, is suitable for the main component of the lubricant to be used in the process of the present invention. Therefore, "a lubricant composed mainly of borax" or "borax" might be referred to in the specification, instead of an "alkali metal borate".

The steel grade in which the process of the present invention is applicable is such steel as a carbon steel or a low-alloy steel, which is easy to generate scale composed mainly of iron oxide.

BEST MODE FOR CARRYING OUT THE INVENTION

Even if the lubricant composed mainly of borax is applied onto the inner surface of the hollow stock pipe in mandrel mill rolling as described above, the effect may not be sufficiently exhibited in some cases. As a result of investigations, the present inventors found that it is attributable to the following fact. Namely, the lubricant cannot be properly melted when applied into the stock pipe, or cannot be uniformly distributed onto the whole inner surface of the stock pipe even if melted. This causes a locally increased friction coefficient in rolling, resulting in a deterioration of inner surface quality.

In order to prevent such an undesirable situation, it is necessary to properly control the temperature of the inner surface of the stock pipe in applying the lubricant composed mainly of an alkali metal borate, and to optimize the condition of elongation rolling after applying the lubricant. The present invention is based on such knowledge.

A technique for uniformly applying a lubricant to the whole inner surface of a pipe has already been put into practical use. This technique can also be used in the process of the present invention.

The present inventors found that if scale is present on inner surface of the stock pipe before applying the lubricant composed mainly of an alkali metal borate, the lubricant can be easily melted and is uniformly distributed onto the whole inner surface of the stock pipe. This is attributable to the reasons (1) and (2) described below.

(1) It is related to the wettability of the melted lubricant to scale composed mainly of iron oxide, and the melted borax has a more satisfactory wettability to scale than to steel.

(2) Not only the lubricant but also the scale is melted by the cross-reaction of the lubricant and the scale, and the melted lubricant is uniformly distributed to the inner surface of the stock pipe due to its good flowability to scale.

When the wettability is good, not only the melted borax spreads easily, but also the melting is facilitated with a good heat transfer property since a part of the borax contacting with inner surface of the stock pipe can be easily spread even if applied in a massy state. When the wettability is poor, the borax is left in the massy state since the part of the borax contacting with the inner surface of the stock pipe is difficult to spread, and the heat transfer to the inner part is delayed, which disturbs the melting.

It is important for the above-mentioned reasons to generate a proper amount of scale onto the inner surface of the stock pipe before applying the lubricant composed mainly of an alkali metal borate.

1. Requirement (a)

The requirement for generating scale in a proper thickness onto the inner surface of the stock pipe is Requirement (a). Specifically, it is necessary to set the temperature of the inner surface of the stock pipe immediately after the completion of piercing at not lower than 1150° C., more desirably for not lower than 1200° C., and set the time from the completion of piercing to applying of the lubricant. composed mainly of an alkali metal borate. for not less than 5 seconds, more desirably for not less than 10 seconds. This time is applied to a case in which no descaling using high-pressure water or the like is performed from the completion of piercing to the initiation of applying the lubricant. When the descaling is performed before applying the lubricant, it is necessary to set the time from the completion of descaling to the initiation of applying the lubricant for not less than 5 seconds, more desirably for not less than 10 seconds.

An excessively large mount of scale deteriorates the inner surface quality of the pipe, since the scale cannot be perfectly melted even by applying the lubricant composed mainly of an alkali metal borate, then some is partially left without melting. Therefore, the time from the completion of piercing to applying of the alkali metal borate should not be excessively prolonged. Also, the time from the completion of descaling to applying the alkali metal borate should not be excessively prolonged.

A number of tests resulted where the thickness of the scale was preferably within the range of 5 to 30 μm. For confirming a heating temperature and a heating time for generating scale having this thickness, the following experiments were carried out.

EXPERIMENT 1

An experiment was carried out in the following procedure to examine the influence of the heating temperature and the heating time on the thickness of the scale, and the result is shown in FIG. 1.

(1) A plate of carbon steel of 30×30×6 (mm) was taken as a test piece and heated to and held at a predetermined temperature in nitrogen gas.

(2) Thereafter, the test piece was exposed to air for a predetermined time (various seconds shown in the vertical axis of FIG. 1), and then immediately exposed to nitrogen gas, and cooled.

(3) After the cooling, micro-observation of a section of the test piece was performed to measure the thickness of scale.

In FIG. 1, the actual line shows a case where the thickness of scales becomes 5 μm, and the dotted line shows a case where the thickness of scale became 20 μm. Namely, when the heating temperature of the test piece was 1150° C., the thickness of scale becomes 5 μm when exposed to air for 5 seconds, and 20 μm when exposed to air for 65 seconds.

Since the above-mentioned test was a so-called laboratory test, it was slightly different from an actual production line of the seamless steel pipe. However, it can be said, permitting for this difference, that the scale of thickness 5 to 20 μm is generated by taking an exposure time of 5 to 60 seconds and setting the exposure temperature on the inner surface of pipe at not lower than 1150° C. The temperature of inner surface of the stock pipe after piercing is about 1250° C. maximum. Since the temperature of inner surface of stock pipe is reduced with the lapse of time, the scale thickness never exceeds 30 μm after the lapse of 60 seconds even at 1250° C.

Based on the above experimental result, it is regulated in Requirement (a) that the stock pipe surface temperature after piercing should not be lower than 1150° C., and the time between the end of piercing and the applying of the lubricant or between the end of descaling and the applying of the lubricant should be set to 5 to 60 seconds. The reason for using the end of the descaling as the base is that the application of descaling requires a regeneration of the scale of a proper thickness after the descaling.

2. Requirement (b) and Requirement (c)

The lubricant composed mainly of borax that is applied into the stock pipe is melted with the scale, and spread on the inner surface of the stock pipe. At this time, when the temperature of the inner surface of the stock pipe is low, the melted mixture of lubricant and scale (hereinafter referred to as "melted mixture") is not sufficiently spread because of its increased viscosity. Therefore, the temperature of the inner surface of the stock pipe immediately before applying the lubricant needs to be not lower than 1100° C., more desirably not lower than 1150° C. The lubricant adhered to the inner surface of the stock pipe cannot be spread in an instant, and needs time for spreading. For spreading the lubricant, a time is needed of not less than 10 seconds, more desirably not less than 20 seconds, from the completion of applying the lubricant to the initiation of elongation rolling. These requirements could be confirmed by the following experiment.

EXPERIMENT 2

An experiment was performed in the following procedure to examine the influence of the heating temperature and heating time on the spreading property of borax.

(1) A plate of carbon steel of 125×125×6 (mm) is heated to and held at a predetermined temperature in nitrogen gas.

(2) Thereafter, the one to be scaled is exposed to air only for 30 seconds and then immediately exposed to nitrogen gas. The scale of 10 to 20 μm thick is adhered by this treatment.

(3) The heated plate of carbon steel is taken as a test piece, and left in a furnace for a predetermined time while placing 0.2 g of borax in the center thereof.

(4) After the lapse of a predetermined time, the plate is immediately taken out of the furnace and cooled.

(5) After the cooling, the area S of the melted borax that is spread in an elliptic shape is calculated by the following equation:

$$S=\pi ab$$

wherein a is the radius of the long axis of the ellipse and b is the radius of short axis of the ellipse.

The experimental result is shown in FIG. 2. In the drawing, the actual line shows the result of the case in which scaling was performed to the test piece before placing the borax, and the dotted line shows the result of the case without scaling. Each line is obtained by plotting the time required for borax to spread to 2000 $mm^2$ or more. It was found from these results that sufficient spreading of the melted mixture can be ensured on the surface with the scale adhered thereto with the time of 10 seconds or more if the temperature is not lower than 1100° C.

3. Requirement (d)

A proper rolling requirement in applying the lubricant composed mainly of an alkali metal borate into the stock pipe was then examined in detail. As a result, it was found that a proper range exists for the temperature of the inner surface of the stock pipe immediately before elongation rolling. Specifically, it is necessary that the temperature of inner surface of the stock pipe immediately before elongation rolling is 1000 to 1170° C. and, more desirably 1050 to 1120° C. Further, when the temperature of the inner surface of the stock pipe is 1000 to 1050° C., the average temperature of the surface of the mandrel bar to be used for mandrel mill rolling is desirably not lower than 80° C.

This results from the lubricating property of the lubricant composed mainly of an alkali metal borate and the lubricating property of the bar lubricant to be coated onto the surface of the bar. The necessity for the lower limit of the inner surface of the stock pipe temperature immediately before elongation rolling to be 1000° C. (more desirably 1050° C.) conceivably results from the lubricating characteristic, which is composed mainly of an alkali metal borate. This lubricant can be effective only when the temperature of the interface between the bar and the stock pipe is high and the viscosity of the melted mixture present in the interface is low.

On the other hand, it is necessary for the temperature of the inner surface of the stock pipe immediately before elongation rolling to be not higher than 1170° C., more desirably not higher than 1120° C., so the results from the heat resistance temperature of graphite, mica or the like, that is the main component of the lubricant, be coated onto the surface of the bar. Since these are burnt or thermally decomposed at a high temperature, there is an upper limit for the applicable temperature exists.

EXAMPLE

A stock pipe obtained by piercing a billet of carbon steel with a C content of 0.2% was elongated and rolled by Mannesmann-mandrel mill process to verify the effectiveness of the present invention. The rolling arrangement is as follows:

1. Billet dimension: Diameter 310 mm, and length 2997 mm
2. Stock pipe dimension before mandrel mill rolling: Outer diameter 324 mm, wall thickness 33 mm, and length 7818 mm
3. Dimension after mandrel mill rolling: Outer diameter 276 mm, wall thickness 17 mm, and length 16420 mm
4. Product dimension: Outer diameter 197 mm, wall thickness 20 mm, and length 19841 mm After piercing by a piercer mill and before provided to the mandrel mill, a powdery lubricant consisting of a mixture of 80 mass % of borax and 20 mass % of metallic soap was applied to the inside of the stock pipe. The applying was performed by mixing the above-mentioned lubricant to a carrier gas to be sent into an injection pipe from a carrier gas supplier through a valve, inserting a nozzle at the tip of the injection pipe into the stock pipe, and spraying the lubricant on the inner surface. The applied amount was set to 100 g per $m^2$ of the inner surface of the stock pipe. The temperature of the inner surface of the stock pipe was measured by use of a radiation thermometer.

The mandrel bar used for mandrel mill rolling is made of tool steel of SKD6 defined by the JIS (Japan Industrial Standard), with Cr plating 50 μm thick on the surface. A graphite-based or mica-based aqueous lubricant was applied onto the Cr plating, as shown in Table 1, and dried to form a dry solid lubricating film 100 μm thick. The graphite-based lubricant was obtained by mixing graphite with a resin-based organic binder in a mass ratio of 3:1. The mica-based lubricant was obtained by mixing mica with a borate-based inorganic binder in a mass ratio of 2:1. Each of these lubricants was applied as an aqueous solution so that the dry film had a thickness of 100 μm.

Various test requirements and evaluation results for the friction coefficient during elongation rolling and the inner surface quality of steel pipe products are shown in Tables 1 and 2. The evaluation standards are as follows:

(1) Friction Coefficient

The friction coefficient was determined by reading, from a record chart during mandrel mill rolling, the ratio of thrust force (F) on the mandrel bar to the total load ($\Sigma pi$) in a steady state where the load was applied to all the stands, and then calculating $F/\Sigma pi$ as the friction coefficient. Regarding the friction coefficient, those with a value of not more than 0.03 were evaluated as ○○, those with 0.031 to 0.04 as ○, those with 0.041 to 0.05 as Δ, and those with not less than 0.051 as ×, respectively.

(2) Inner Surface Quality

The inner surface quality was evaluated as the occurrence rate of the linear flaws in the axial direction of the inner surface of a steel pipe products (the number of steel pipes with flaws of the total number of steel pipe products being expressed in %). Those with an occurrence rate of less than 0.5 were evaluated as ○○, those with 0.5 to 1.0% as ○, those with more than 1.0% and not more than 2.0% as Δ, and those with more than 2.0% as ×, respectively.

Since, regarding Nos. 3 to 20 and Nos. 33 to 38 in Tables 1 and 2, the descaling of the stock pipe inner surface was performed between the completion of piercing and the initiation of elongation rolling, the time from the completion of descaling to the initiation of applying the lubricant was entered in the column of the time from the completion of piercing to the initiation of applying the lubricant.

TABLE 1

| | No. | Temperature of Inner Surface of Stock Pipe immediately after Piercing (° C.) | Time from Completion of Piercing to Initiation of Applying Lubricant (Time from Completion of Descaling to Initiation of Applying Lubricant) (sec) | Temperature of Inner Surface of Stock Pipe immediately before Initiation of Applying Lubricant (° C.) | Time from Completion of Applying Lubricant to Initiation of Elongation Rolling (sec) | Temperature of Inner Surface of Stock Pipe immediately before Initiation of Elongation Rolling (° C.) | Temperature of Bar surface immediately before Elongation Rolling (° C.) | Main lubricant coated on Bar surface | Friction Coefficient | Inner Surface Quality |
|---|---|---|---|---|---|---|---|---|---|---|
| The invention | 1 | 1150 | 5 | 1140 | 20 | 1080 | 25 | Graphite | ○ | ○ |
| | 2 | 1150 | 10 | 1130 | 20 | 1070 | 25 | Graphite | ○ | ○ |
| | 3 | 1150 | (30) | 1100 | 30 | 1010 | 25 | Graphite | ○ | ○ |
| | 4 | 1150 | (30) | 1100 | 30 | 1010 | 60 | Graphite | ○ | ○ |
| | 5 | 1150 | (30) | 1100 | 30 | 1010 | 80 | Graphite | ○○ | ○ |
| | 6 | 1150 | (30) | 1100 | 30 | 1010 | 100 | Graphite | ○○ | ○ |
| | 7 | 1150 | (30) | 1100 | 20 | 1040 | 25 | Graphite | ○ | ○ |
| | 8 | 1150 | (30) | 1100 | 20 | 1040 | 60 | Graphite | ○ | ○ |
| | 9 | 1150 | (30) | 1100 | 20 | 1040 | 80 | Graphite | ○○ | ○ |
| | 10 | 1150 | (30) | 1100 | 20 | 1040 | 100 | Graphite | ○○ | ○ |
| | 11 | 1150 | (30) | 1100 | 10 | 1060 | 25 | Graphite | ○○ | ○ |
| | 12 | 1150 | (30) | 1100 | 30 | 1010 | 25 | Mica | ○ | ○ |
| | 13 | 1150 | (30) | 1100 | 20 | 1040 | 25 | Mica | ○ | ○ |
| | 14 | 1150 | (30) | 1100 | 10 | 1060 | 25 | Mica | ○○ | ○○ |
| | 15 | 1150 | (30) | 1100 | 30 | 1010 | 60 | Mica | ○ | ○ |
| | 16 | 1150 | (30) | 1100 | 30 | 1010 | 80 | Mica | ○○ | ○○ |
| | 17 | 1150 | (30) | 1100 | 30 | 1010 | 100 | Mica | ○○ | ○○ |
| | 18 | 1150 | (30) | 1100 | 20 | 1040 | 60 | Mica | ○ | ○ |
| | 19 | 1150 | (30) | 1100 | 20 | 1040 | 80 | Mica | ○○ | ○○ |
| | 20 | 1150 | (30) | 1100 | 20 | 1040 | 100 | Mica | ○○ | ○○ |
| | 21 | 1180 | 60 | 1120 | 20 | 1060 | 25 | Graphite | ○ | ○ |
| | 22 | 1180 | 60 | 1120 | 10 | 1080 | 25 | Graphite | ○ | ○ |
| | 23 | 1200 | 10 | 1180 | 20 | 1120 | 25 | Graphite | ○○ | ○○ |
| | 24 | 1200 | 10 | 1180 | 20 | 1120 | 25 | Mica | ○○ | ○○ |
| | 25 | 1200 | 60 | 1140 | 20 | 1080 | 25 | Graphite | ○ | ○ |
| | 26 | 1220 | 5 | 1210 | 10 | 1170 | 25 | Graphite | ○ | ○ |
| | 27 | 1220 | 5 | 1210 | 10 | 1170 | 25 | Mica | ○ | ○ |
| | 28 | 1220 | 60 | 1160 | 20 | 1100 | 25 | Graphite | ○○ | ○○ |
| | 29 | 1220 | 60 | 1160 | 10 | 1120 | 25 | Graphite | ○○ | ○ |

TABLE 2

| | No. | Temperature of Inner Surface of Stock Pipe immediately after Piercing (° C.) | Time from Completion of Piercing to Initiation of Applying Lubricant (Time from Completion of Descaling to Initiation of Applying Lubricant) (sec) | Temperature of Inner Surface of Stock Pipe immediately before Initiation of Applying Lubricant (° C.) | Time from Completion of Applying Lubricant to Initiation of Elongation Rolling (sec) | Temperature of Inner Surface of Stock Pipe immediately before Initiation of Elongation Rolling (° C.) | Temperature of Bar surface immediately before Elongation Rolling (° C.) | Main lubricant coated on Bar surface | Friction Coefficient | Inner Surface Quality |
|---|---|---|---|---|---|---|---|---|---|---|
| Comparative | 30 | 1130 | 5 | 1120 | 20 | 1060 | 25 | Graphite | Δ | x |
| | 31 | 1150 | 0 | 1150 | 20 | 1090 | 25 | Graphite | Δ | x |
| | 32 | 1150 | 60 | 1090 | 20 | 1030 | 25 | Graphite | Δ | x |
| | 33 | 1150 | (30) | 1100 | 40 | 990 | 25 | Graphite | x | x |
| | 34 | 1150 | (30) | 1100 | 40 | 990 | 80 | Graphite | x | x |
| | 35 | 1150 | (30) | 1100 | 40 | 990 | 100 | Graphite | x | x |
| | 36 | 1150 | (30) | 1100 | 40 | 990 | 25 | Mica | x | x |
| | 37 | 1150 | (30) | 1100 | 40 | 990 | 80 | Mica | x | x |
| | 38 | 1150 | (30) | 1100 | 40 | 990 | 100 | Mica | x | x |
| | 39 | 1200 | 80 | 1120 | 20 | 1060 | 25 | Graphite | Δ | x |

TABLE 2-continued

| No. | Temperature of Inner Surface of Stock Pipe immediately after Piercing (° C.) | Time from Completion of Piercing to Initiation of Applying Lubricant (Time from Completion of Descaling to Initiation of Applying Lubricant) (sec) | Temperature of Inner Surface of Stock Pipe immediately before Initiation of Applying Lubricant (° C.) | Time from Completion of Applying Lubricant to Initiation of Elongation Rolling (sec) | Temperature of Inner Surface of Stock Pipe immediately before Initiation of Elongation Rolling (° C.) | Temperature of Bar surface immediately before Elongation Rolling (° C.) | Main lubricant coated on Bar surface | Friction Coefficient | Inner Surface Quality |
|---|---|---|---|---|---|---|---|---|---|
| 40 | 1220 | 60 | 1160 | 5 | 1130 | 25 | Graphite | Δ | x |
| 41 | 1240 | 5 | 1230 | 10 | 1190 | 25 | Graphite | x | x |
| 42 | 1240 | 5 | 1230 | 10 | 1190 | 25 | Mica | Δ | x |

As is apparent from Tables 1 and 2, according to the process of present invention that satisfies all the above-mentioned requirements (a) to (d), the friction coefficient is small, and the inner surface quality of the steel pipe product is satisfactory. On the other hand, when at least any one of the requirements (a) to (d) is not satisfied, the friction coefficient is increased, and the satisfactory inner surface quality cannot be ensured.

INDUSTRIAL APPLICABILITY

According to the process of the present invention, in manufacturing a seamless steel pipe by Mannesmann-mandrel mill process, the friction coefficient in the mandrel mill rolling can be reduced and then the seamless steel pipe can be manufactured without causing flaws on the inner surface.

Figure 1:
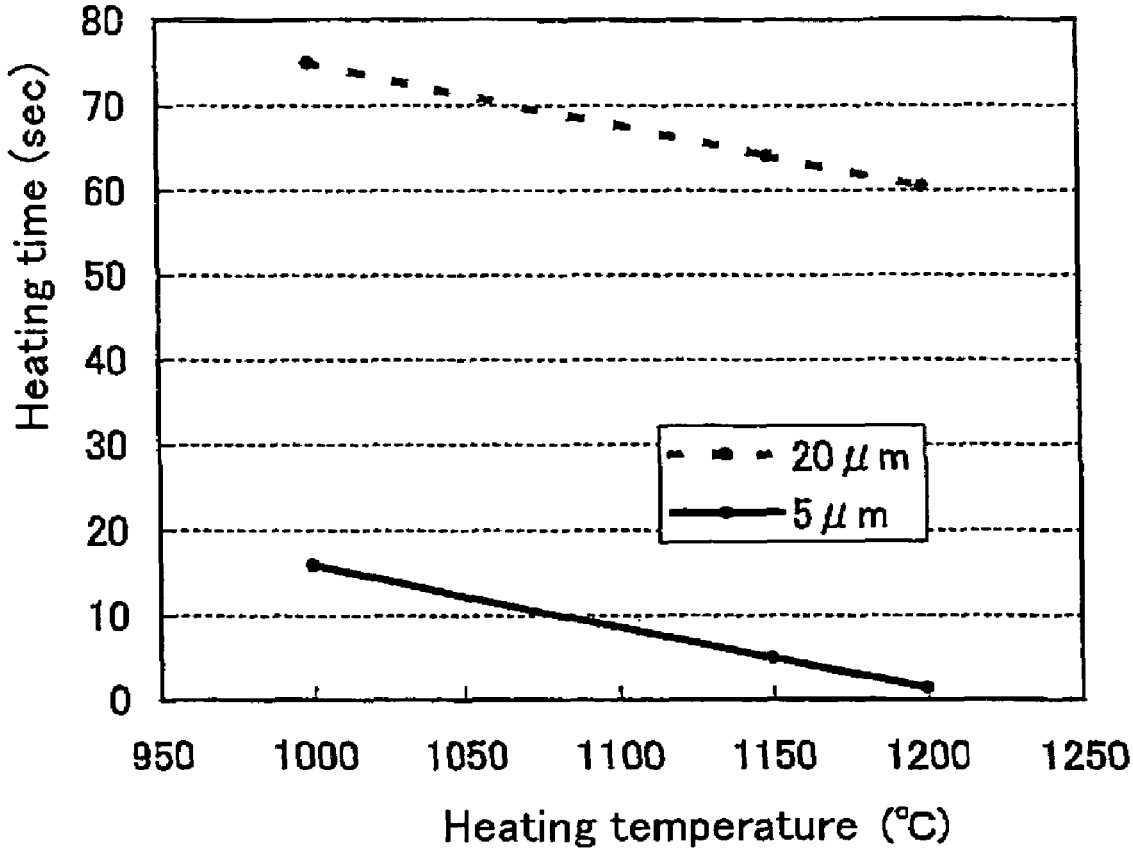
FIG. 1 A view showing the influence of the heating temperature and heating time of a steel plate that is a test piece on the thickness of scale generated.
Figure 2:
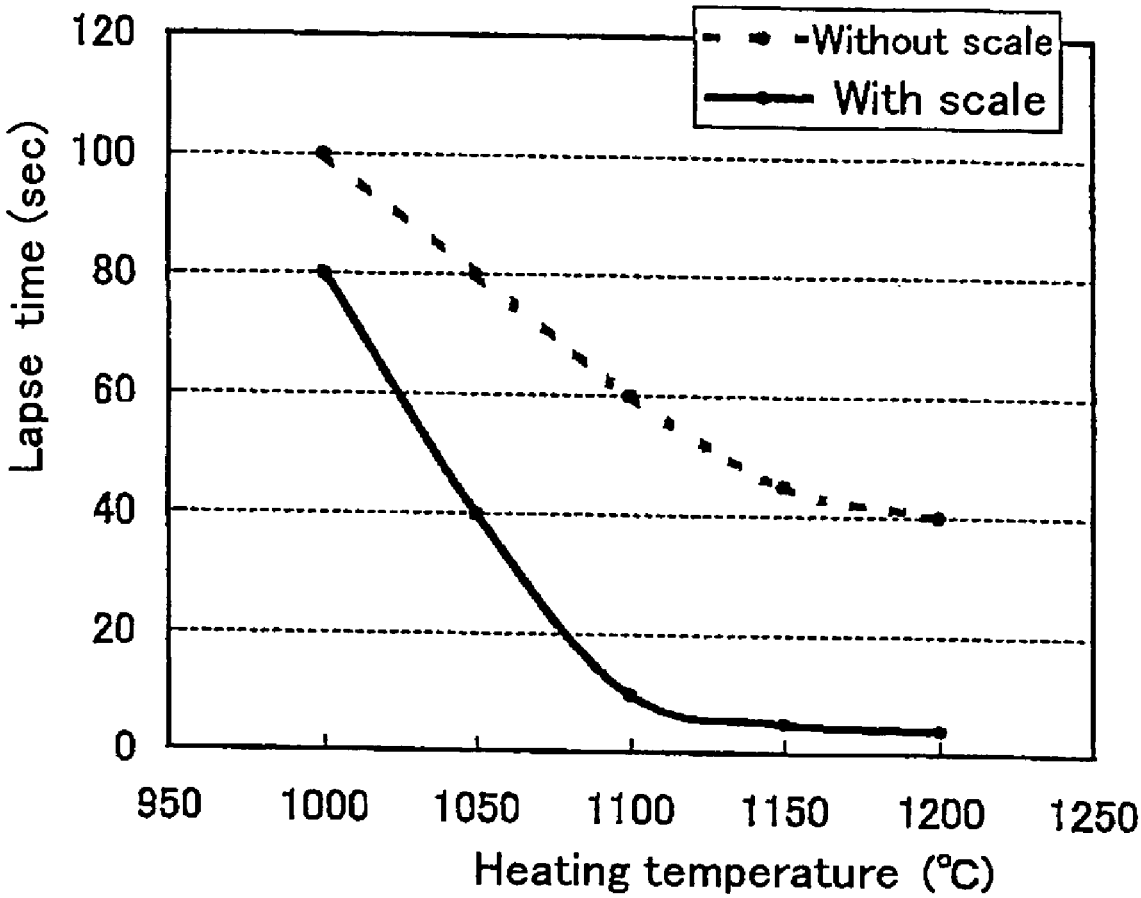
FIG. 2 A view showing the influence of the heating temperature and the lapse time on spreading of a lubricant composed mainly of borax.

The invention claimed is:

1. A process for producing a seamless steel pipe excellent in inner surface quality, characterized by, comprising, during the elongation rolling of a hollow stock pipe by means of a mandrel mill, coating with a lubricant composed mainly of either or both of graphite and mica to the surface of a mandrel bar and further applying a lubricant composed mainly of an alkali metal borate onto the inner surface of the hollow stock pipe, and also characterized by satisfying the following requirements (a) to (d):

(a) the temperature of inner surface of stock pipe immediately after the completion of piercing being set for not lower than 1150° C., and the time from the completion of piercing to the initiation of applying the lubricant composed mainly of an alkali metal borate, or the time from the completion of descaling to the initiation of applying the lubricant composed mainly of an alkali metal borate is set for 5 to 60 seconds, (b) the temperature of inner surface of stock pipe during applying the lubricant composed mainly of an alkali metal borate being set for not lower than 1100° C., (c) the time from the completion of applying the lubricant composed mainly of an alkali metal borate to the initiation of elongation rolling being set for not less than 10 seconds:

(d) the temperature of inner surface of stock pipe immediately before the elongation rolling being set within a range from 1000 to 1170° C.

* * * * *